US009014591B2

(12) United States Patent
Nakai et al.

(10) Patent No.: US 9,014,591 B2
(45) Date of Patent: Apr. 21, 2015

(54) CHARGING DEVICE, AND IMAGE FORMING APPARATUS INCLUDING THE SAME

(71) Applicant: KYOCERA Document Solutions Inc., Osaka-shi, Osaka (JP)

(72) Inventors: Jun Nakai, Osaka (JP); Katsuya Ota, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/278,327

(22) Filed: May 15, 2014

(65) Prior Publication Data

US 2014/0341608 A1 Nov. 20, 2014

(30) Foreign Application Priority Data

May 16, 2013 (JP) ..... 2013-104539

(51) Int. Cl.
*G03G 15/02* (2006.01)

(52) U.S. Cl.
CPC ..... *G03G 15/0258* (2013.01)

(58) Field of Classification Search
CPC ..... G03G 15/0258
See application file for complete search history.

(56) References Cited

U.S. PATENT DOCUMENTS

2002/0106212 A1* 8/2002 Amemiya et al. ..... 399/100
2007/0269234 A1* 11/2007 Kurita et al. ..... 399/111
2010/0119251 A1* 5/2010 Miyamoto ..... 399/100
2011/0299890 A1 12/2011 Imanaka et al.

FOREIGN PATENT DOCUMENTS

JP 2012014143 A 1/2012

* cited by examiner

*Primary Examiner* — Sandra Brase
(74) *Attorney, Agent, or Firm* — Alleman Hall McCoy Russell & Tuttle LLP

(57) ABSTRACT

A charging device includes a housing, a charging roller, and a brush roller. The housing is disposed adjacent to an optical path of light emitted an the exposure device to irradiate a photoconductor. Charging roller is rotatably supported in housing, and is configured to charge a circumferential surface of the photoconductor through contact. Brush roller is rotatably supported in housing together with charging roller, has multiple brush hairs flocked on a base shaft thereof extending in a longitudinal direction of the charging roller, and is configured to clean a surface of charging roller when brush hairs are brought in contact with charging roller. Furthermore, a predetermined segment of housing is located in a space within a predetermined distance toward a side of housing from the optical path, and is formed from a material having a charge property equivalent to that of the brush hairs.

6 Claims, 6 Drawing Sheets

CHARGING DEVICE, AND IMAGE FORMING APPARATUS INCLUDING THE SAME

INCORPORATION BY REFERENCE

This application is based upon and claims the benefit of priority from the corresponding Japanese Patent Application No. 2013-104539 filed on May 16, 2013, the entire contents of which are incorporated herein by reference.

BACKGROUND

The present disclosure relates to a charging device including a charging roller that charges a photoconductor through contact and a brush roller that cleans the surface of the charging roller, and an image forming apparatus including the charging device.

Hitherto, image forming apparatuses utilizing electrophotographic printing such as copying machines, printers, and facsimiles are known. Such an image forming apparatus includes a drum type photoconductor, a charging device disposed so as to follow along the outer circumferential surface thereof, an exposure device, a developing device, and a transfer device etc. The charging device charges the surface of the photoconductor to obtain a predetermined electric potential, and includes a charging roller that is brought in contact with the surface of the photoconductor, and a brush roller that removes a toner adhered to the surface of the charging roller. The charging roller and the brush roller are rotatably supported inside a housing.

SUMMARY

A charging device according to one aspect of the present disclosure includes a housing, a charging roller, and a brush roller. The housing is disposed adjacent to an optical path of light emitted from an exposure device to irradiate a photoconductor. The charging roller is rotatably supported in the housing, and is configured to charge a circumferential surface of the photoconductor through contact. The brush roller is rotatably supported in the housing together with the charging roller, has multiple brush hairs flocked on a base shaft thereof extending in a longitudinal direction of the charging roller, and is configured to clean a surface of the charging roller when the brush hairs are brought in contact with the charging roller. Furthermore, a predetermined segment of the housing is located in a space within a predetermined distance toward a side of the housing from the optical path, and is formed from a material having a charge property equivalent to that of the brush hairs.

An image forming apparatus according to another aspect of the present disclosure includes the aforementioned charging device, a photoconductor, a developing device, and an exposure device. The photoconductor has its surface charged by the charging device and is rotationally driven in one direction. The developing device is disposed downstream of the charging device in a rotation direction of the photoconductor, and is configured to supply a toner on a surface of the photoconductor. The exposure device is configured to emit light toward a surface of the photoconductor from between the charging device and the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the drawings as appropriate. The embodiments described below represent exemplary implementations of the present disclosure, and the technical scope of the present disclose is not limited by the embodiments described below.

[Outlined Configuration of Multifunction Peripheral 1]

Firstly, an outlined configuration of a multifunction peripheral 1 (one example of an image forming apparatus of the present disclosure) according to an embodiment of the present disclosure will be described with reference to FIG. 1.

Figure 1:
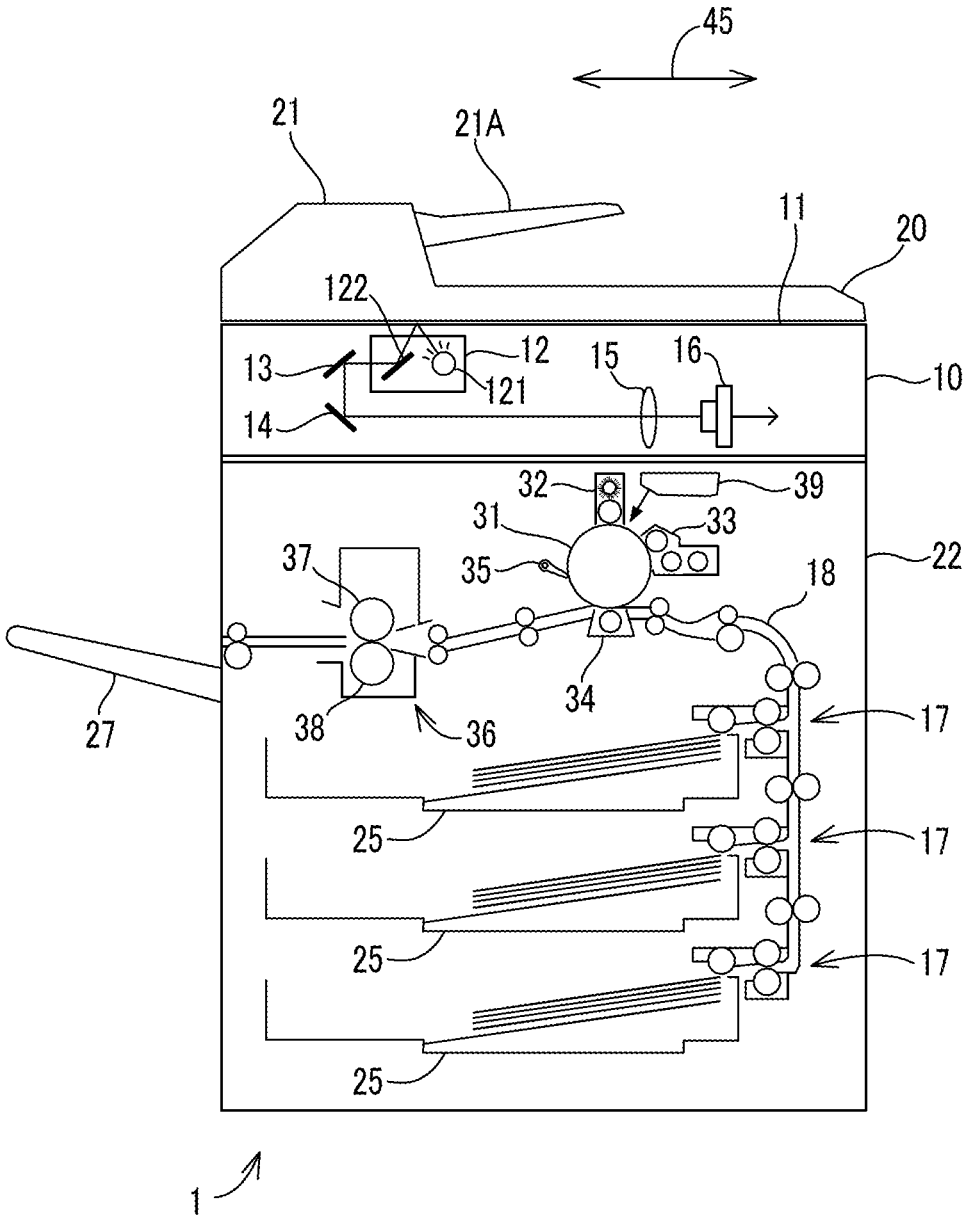
FIG. 1 schematically illustrates an outlined configuration of a multifunction peripheral according to an embodiment of the present disclosure.

The multifunction peripheral 1 shown in FIG. 1 is an image forming apparatus having each of the functions of a printer, a copying machine, and a facsimile etc. The multifunction peripheral 1 prints an image on a print sheet (sheet material) based on inputted image data, using developing materials such as a toner. The multifunction peripheral 1 includes an image reading portion 10 that reads an image on a document sheet and an image forming portion 22 of electrophotographic method, respectively on an upper part and on a lower part of the multifunction peripheral 1. In the present embodiment, the multifunction peripheral 1 is illustrated as an example of the image forming apparatus of the present disclosure. However, the image forming apparatus is not limited thereto, and may be, for example, a printer, a facsimile device, or a copying machine.

[Image Reading Portion 10]

The image reading portion 10 includes a contact glass 11 that forms a document sheet mounting surface, and a document sheet cover 20 that opens and closes with respect to the contact glass 11. When the multifunction peripheral 1 is to function as a copying machine, a document sheet is set on the contact glass 11, the document sheet cover 20 is closed, and, when a copy-start instruction is inputted from a control panel that is not shown, a reading operation by the image reading portion 10 is initiated to read image data on the document sheet. Optical devices such as a reading unit 12 including an LED light source 121 and a mirror 122, mirrors 13 and 14, an optical lens 15, and a CCD 16 are disposed inside the image reading portion 10. The reading unit 12 is moved in a sub-scanning direction 45 by a motor or the like. Light emitted toward the contact glass 11 from the LED light source 121 during the movement is scanned in the sub-scanning direction 45, and reflected light therefrom is inputted in the CCD 16. With this, image of the document sheet placed on the contact glass 11 is read.

An ADF 21 is disposed on the document sheet cover 20. The ADF 21 sequentially conveys a plurality of document sheets set on a document sheet set portion 21A by means of a plurality of conveying rollers (not shown), and moves the document sheets rightward in the sub-scanning direction 45 through a reading position defined on the contact glass 11. When a document sheet is moved by the ADF 21, the reading unit 12 is disposed below the reading position, and an image of the document sheet that is being moved is read by the reading unit 12 at this position.

[Image Forming Portion 22]

Figure 2:
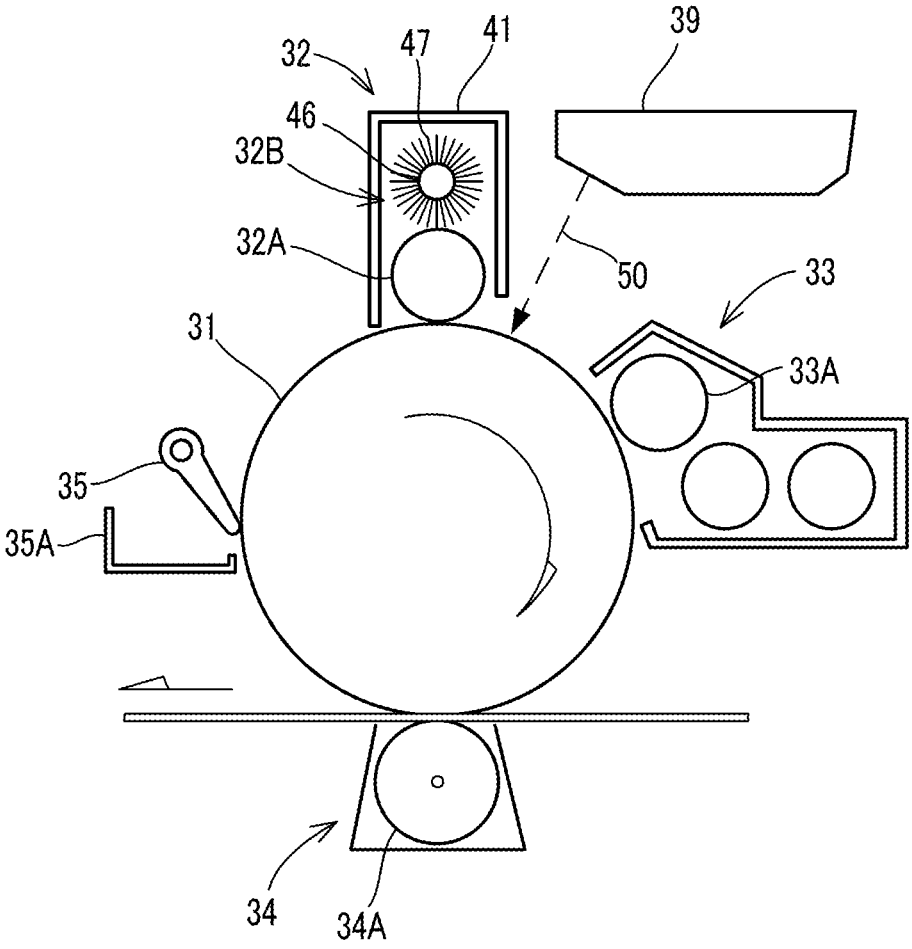
FIG. 2 shows a configuration of the periphery of a photoconductor drum of the multifunction peripheral shown in FIG. 1.

The image forming portion 22 which is a portion for image formation is configured to execute an image formation process (printing process) by electrophotography based on image data read by the image reading portion 10 or image data inputted from an external information processing apparatus. As shown in FIGS. 1 and 2, the image forming portion 22 includes sheet feed cassettes 25, a photoconductor drum 31 (one example of a photoconductor of the present disclosure), a charging device 32 (one example of a charging device of the present disclosure), a developing device 33, a transfer device 34, a cleaning blade 35, a fixing device 36, an exposure device 39, and a paper sheet discharge portion 27 etc.

As shown in FIG. 1, the sheet feed cassettes 25 are disposed below the image forming portion. In the present embodiment, a total of three of the sheet feed cassettes 25 are arranged in the vertical direction. In each of the sheet feed cassettes 25, a plurality of sheet-like print sheets (sheet materials) are housed in a stacked manner. The print sheets housed in the sheet feed cassettes 25 are taken out one sheet at a time by a feeding portion 17 such as feeding rollers, and then are conveyed toward the transfer device 34 through a conveying path 18 inside the image forming portion 22.

As shown in FIG. 2, the photoconductor drum 31 is a rotational body formed in a drum shape, and is rotatably supported by a frame or the like inside the image forming portion 22. An outer circumferential surface of the photoconductor drum 31 is charged by the charging device 32 described later to obtain a predetermined electric potential. The photoconductor drum 31 is rotationally driven in a clockwise rotation direction in FIG. 2 when driving force, generated by a drive source such as a motor that is not shown, is transferred thereto. The photoconductor drum 31 has a structure in which a single photosensitive layer is disposed on a surface thereof. More specifically, the photoconductor drum 31 has a single layer structure obtained through vapor deposition of solely a photosensitive layer of an organic photoconductor such as an organic compound whose conductivity increases when being irradiated with light. A conventional organic photoreceptor drum has a three-layer structure of, sequentially from the inside, an undercoating layer, a charge generation layer, and a charge transport layer; whereas the photoconductor drum 31 of the present embodiment achieves the functions of charge generation and charge transport etc., solely by a single photosensitive layer. Therefore, image formation with stable quality is possible unless the photosensitive layer totally wears out. It should be noted that although the photoconductor drum 31 having a photosensitive layer with a single layer structure is illustrated as the photoconductor of the present disclosure, the present disclosure is also applicable to an organic photoreceptor drum obtained by laminating a plurality of layers. It is also possible to use, as the photoconductor of the present disclosure, an amorphous silicon drum obtained through vapor deposition of amorphous silicon on an aluminum element tube.

The charging device 32, the exposure device 39, the developing device 33, the transfer device 34, and the cleaning blade 35 are arranged along the outer circumferential surface of the photoconductor drum 31.

The charging device 32 is disposed above the photoconductor drum 31 in the vertical direction so as to face the outer circumferential surface of the photoconductor drum 31. The charging device 32 uniformly charges the photosensitive layer on the outer circumferential surface of the photoconductor drum 31 to obtain a surface potential with a predetermined polarity in response to a predetermined DC voltage supplied by a charge-voltage supplying portion that is not shown. Details of the charging device 32 will be described later.

The developing device 33 is disposed downstream of the charging device 32 in a rotation direction of the photoconductor drum 31. The developing device 33 includes a developing roller 33A (cf. FIG. 2) on which a bias voltage that is lower than the surface potential of the photoconductor drum 31 is applied. A toner carried from a toner container by the developing roller 33A is supplied on the photoconductor drum 31. It should be noted that the used toner may be a single-component developer which only contains a toner, or a two-component developer which contains a mixture of a carrier and a toner.

The exposure device 39 emits a laser beam toward the photoconductor drum 31 from between the charging device 32 and the developing device 33 to expose the outer circumferential surface of the photoconductor drum 31. With this, an electrostatic latent image in accordance with image information contained in the laser beam is formed on the outer circumferential surface of the photoconductor drum 31. When the outer circumferential surface of the photoconductor drum 31 is irradiated with the laser beam, electric potential of an exposed part that has been irradiated is discharged, and the electrostatic latent image is formed by the exposed part. When a toner is supplied on the photoconductor drum 31 by the developing device 33, the toner adheres to the electrostatic latent image through electrostatic force generated by a difference in electric potential between the electrostatic latent image and the toner.

The transfer device 34 is disposed downstream of the developing device 33 in the rotation direction of the photoconductor drum 31. The transfer device 34 is disposed below the photoconductor drum 31 so as to face the outer circumferential surface of the photoconductor drum 31. The transfer device 34 includes a transfer roller 34A (cf. FIG. 2) that makes contact with the outer circumferential surface of the photoconductor drum 31 and rotates. A constant current of a predetermined value is supplied to the transfer roller 34A. As a result, when a print sheet becomes sandwiched at a nip portion between the photoconductor drum 31 and the transfer roller 34A, the toner on the photoconductor drum 31 adheres to the surface of the print sheet.

The cleaning blade 35 is disposed downstream of the transfer device 34 in the rotation direction of the photoconductor drum 31. The cleaning blade 35 removes a toner that has not been transferred to the paper sheet and has remained on the outer circumferential surface of the photoconductor drum 31, and is formed from silicone rubber or the like. By having the photoconductor drum 31 rotate while the cleaning blade 35 is in contact with the outer circumferential surface of the photoconductor drum 31, a remaining toner is scraped off into a toner receiver 35A.

As shown in FIG. 1, the fixing device 36 is disposed downstream of the transfer device 34 in a conveying direction of a print sheet. The fixing device 36 fixes the toner, which has been transferred to the print sheet, on the print sheet, and includes a heating roller 37 and a pressure roller 38 disposed opposingly to the heating roller 37. The toner that has been transferred to the print sheet is heated, melted, and fixed on the print sheet when the toner passes through the fixing device 36. The print sheet that has passed through the fixing device 36 is discharged in the paper sheet discharge portion 27.

The configuration of the charging device 32 will be described next. As shown in FIG. 2, the charging device 32 includes a charging roller 32A, a brush roller 32B, and a housing 41 that houses those.

The charging roller 32A is rotatably supported inside the housing 41. When the charging roller 32A makes contact with the outer circumferential surface of the photoconductor drum 31 and rotates while voltage is applied on the charging roller 32A, the circumferential surface of the photoconductor drum 31 becomes charged. As the charging roller 32A, one that is obtained by coating a metallic shaft with a material obtained by adding a conductive material to a rubber material such as urethane rubber, silicone rubber, and NBR is used.

The brush roller 32B is rotatably supported inside the housing 41 together with the charging roller 32A. The brush roller 32B is obtained by having multiple brush hairs 47 flocked on the surface of a base shaft 46 extending in the longitudinal direction, i.e., the shaft direction, of the charging roller 32A. In the present embodiment, pile fiber formed from nylon resin, which is cheap and easily processed, is used as the brush hairs 47. The brush hairs 47 flock on the surface of the base shaft 46 through, for example, an electrostatic-flocking process. As shown in FIG. 2, the brush roller 32B is arranged above the charging roller 32A, and is rotatably disposed in a state in which the brush hairs 47 are in contact with the surface of the charging roller 32A located below. By having the brush roller 32B rotate in response to a driving force generated by a drive source such as a motor, the toner adhered to the surface of the charging roller 32A is removed and the charging roller 32A is cleaned. According to the triboelectric series showing the property of how easily a substance is charged, the nylon resin that forms the brush hairs 47 is positively charged more easily than a rubber material. Thus, when the brush hairs 47 make contact with the surface of the charging roller 32A, the brush hairs 47 become positively charged.

As shown in FIG. 2, the housing 41 is disposed adjacent to an optical path 50 of a laser beam emitted from the exposure device 39 to irradiate the surface of the photoconductor drum 31. As described above, the developing device 33 is disposed downstream of the charging device 32 in the rotation direction of the photoconductor drum 31. For the purpose of reducing the size of the multifunction peripheral 1, the developing device 33 and the charging device 32 are arranged adjacent to each other. Thus, the laser beam from the exposure device 39 passes through a narrow gap between the developing device 33 and the charging device 32. As a result, the housing 41 of the charging device 32 is arranged adjacent to the optical path 50. In the present embodiment, the housing 41 is formed from a polystyrene resin or an ABS resin having a relatively large strength so as to rotatably support the charging roller 32A and the brush roller 32B. It should be noted that according to the triboelectric series, an ABS resin and a polystyrene resin are negatively charged more easily than nylon resin.

A surface of the housing 41 facing the photoconductor drum 31 has an opening formed thereon. The charging roller 32A is exposed toward the photoconductor drum 31 from the opening. In the present embodiment, a lower end 41A of the housing 41 on the optical path 50 side is withdrawn away from the surface of the photoconductor drum 31 when compared to a lower end 41B on the opposite side. The purpose thereof is to prevent the lower end 41A from obstructing the laser beam that has passed through the optical path 50.

Figure 3A:
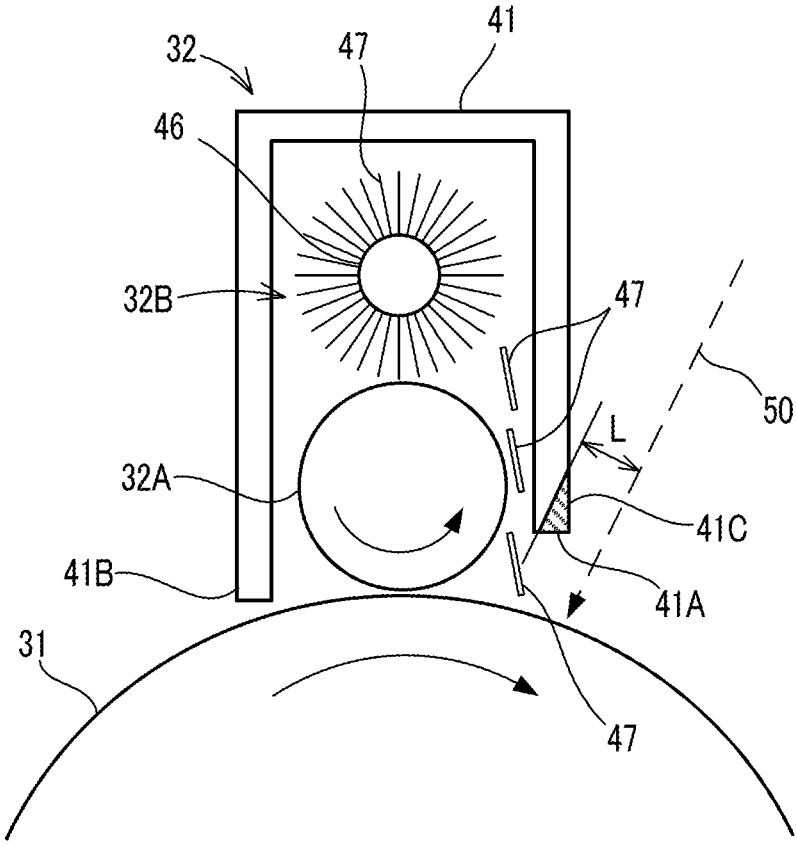
FIG. 3A and FIG. 3B show a configuration of a charging device shown in FIG. 2.

As shown in FIG. 3A, the housing 41 has a lower edge corner 41C (predetermined segment). The lower edge corner 41C is one part of the lower end part of the housing 41, and is located in a space within a predetermined distance L toward the housing 41 side from the optical path 50. The lower edge corner 41C is formed from a material having a charge property equivalent to that of the brush hairs 47. More specifically, the lower edge corner 41C is formed from the same material as the brush hairs 47, i.e., nylon resin. In the present embodiment, a sheet-like nylon film formed from nylon resin is attached to the surface of the lower edge corner 41C formed from a synthetic resin such as an ABS resin.

The predetermined distance L is set to be at least the length of the brush hairs 47 or larger. Thus, the lower edge corner 41C, on which the nylon film is attached, is a part included in a space within at least the length of the brush hairs 47 toward the housing 41 side from the optical path 50.

Figure 3B:
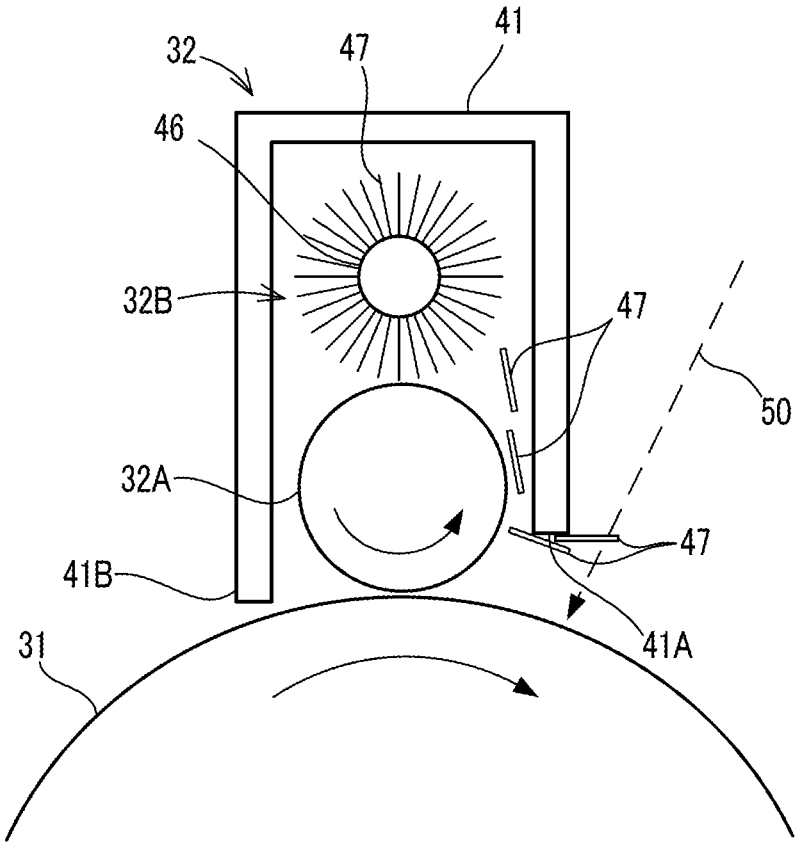

In the following, the advantageous effect of providing the nylon film on the lower edge corner 41C of the housing 41 will be described. If the nylon film is not provided on the lower edge corner 41C of the housing 41, a positively-charged hair fallen off the brush hairs 47 adheres to the easily-negatively-charged lower end part 41A of the housing 41 due to electrostatic force as shown in FIG. 3B. In this case, the optical path 50 adjacent to the housing 41 is obstructed by the brush hair 47, causing a problem of the electrostatic latent image not being accurately formed on the surface of the photoconductor drum 31. However, in the charging device 32 of the present embodiment, the lower edge corner 41C of the housing 41 is covered with the nylon film. The lower edge corner 41C and the fallen brush hair 47 are formed from the same material, and thereby have the same polarity when being charged. As a result, when the lower edge corner 41C and the brush hairs 47 are charged, a mutually repelling force acts therebetween. Thus, the fallen brush hair 47 drops below without adhering to the lower edge corner 41C. With this, the optical path 50 is prevented from being constantly obstructed by the brush hair 47.

It should be noted that, in the aforementioned embodiment, although an example in which the brush hairs 47 and the lower edge corner 41C are formed from the same material has been described, the present disclosure is not limited thereto. The lower edge corner 41C may be formed from a material having a charge property equivalent to that of the brush hairs 47, i.e., a material listed closely in the triboelectric series. In such case, even if electrostatic force acts in a mutually attracting direction, the force is not very strong and the brush hair 47 will not adhere constantly to the lower edge corner 41C to obstruct the optical path 50.

Figure 4A:
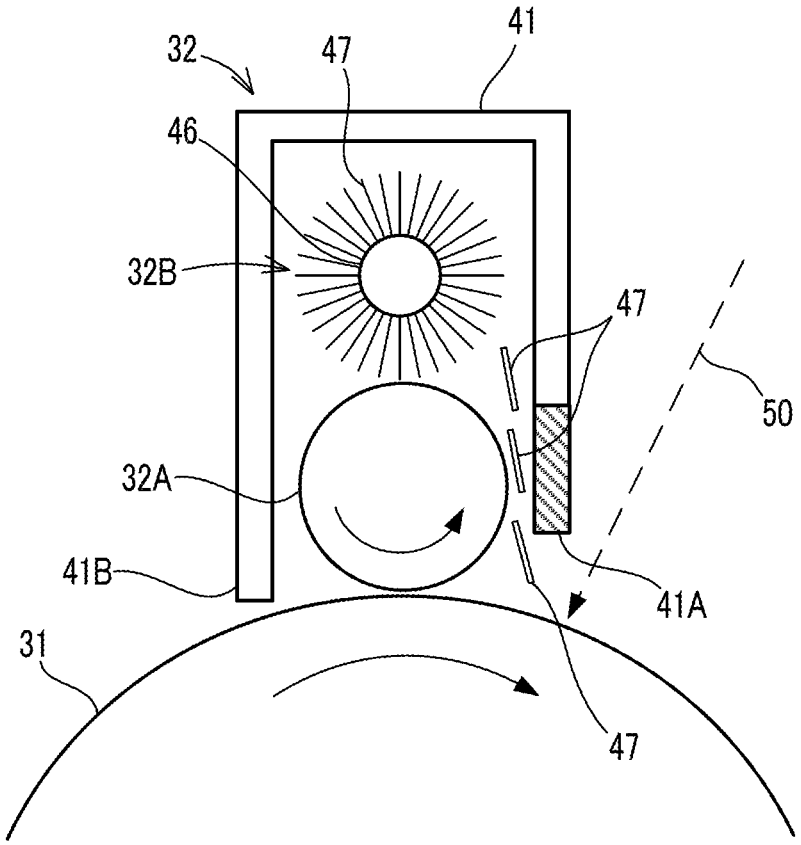
FIG. 4A and FIG. 4B show a modification of a housing of the charging device shown in FIG. 2.
Figure 4B:
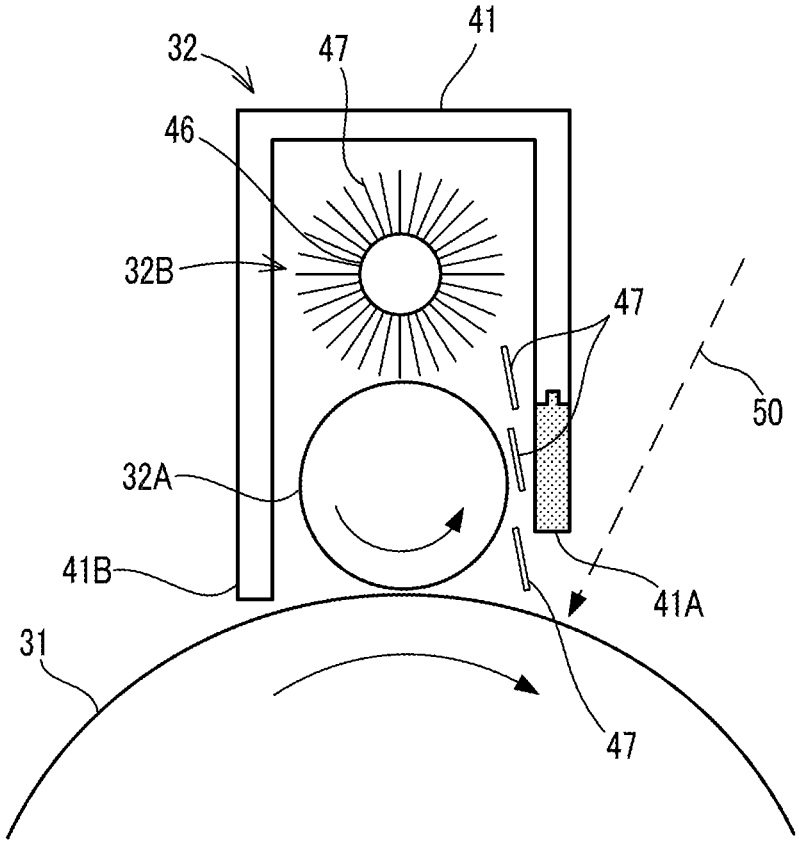

In the aforementioned embodiment, although an example has been described in which only the part included in a space within the predetermined distance L from the optical path 50 is covered with the nylon film, the present disclosure is not limited thereto. For example, as shown in FIG. 4A, the whole lower end part 41A may be covered with the nylon film. Furthermore, as shown in FIG. 4B, instead of the nylon film, the lower end part 41A may be changed to another member formed from nylon resin.

Furthermore, in the aforementioned embodiment, although the image forming apparatus of the present disclosure is illustrated as the multifunction peripheral 1 including the charging device 32, the present disclosure may be achieved as an independent device of the charging device 32.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A charging device comprising:

a housing disposed adjacent to an optical path of light emitted from an exposure device to irradiate a photoconductor;

a charging roller that is rotatably supported in the housing and is configured to charge a circumferential surface of the photoconductor through contact; and a brush roller that is rotatably supported in the housing together with the charging roller, that has multiple brush hairs flocked on a base shaft extending in a longitudinal direction of the charging roller, and that is configured to clean a surface of the charging roller when the brush hairs are brought in contact with the charging roller, wherein a predetermined segment of the housing is located in a space within a predetermined distance toward a side of the housing from the optical path, and is formed from a material having a charge property equivalent to that of the brush hairs.

2. The charging device according to claim 1, wherein the predetermined distance is at least a length of the brush hairs.

3. The charging device according to claim 1, wherein the predetermined segment is covered with a sheet-like film formed from a material having a charge property equivalent to that of the brush hairs.

4. The charging device according to claim 1, wherein the brush hairs and the predetermined segment are formed from nylon resin, a surface of the charging roller is formed from a rubber material, and the housing is formed from an ABS resin or a polystyrene resin.

5. The charging device according to claim 1, wherein the housing is disposed above the photoconductor in a vertical direction, and has an opening formed on a surface thereof facing the photoconductor.

6. An image forming apparatus comprising:

the charging device according to claim 1;

a photoconductor whose surface is charged by the charging device, and that is rotationally driven in one direction;

a developing device disposed downstream of the charging device in a rotation direction of the photoconductor, and configured to supply toner on a surface of the photoconductor; and an exposure device configured to emit light toward a surface of the photoconductor from between the charging device and the developing device.

* * * * *